US007474294B2

(12) United States Patent
Leo et al.

(10) Patent No.: US 7,474,294 B2
(45) Date of Patent: Jan. 6, 2009

(54) USE OF A PLURALITY OF LIGHT SENSORS TO REGULATE A DIRECT-FIRING BACKLIGHT FOR A DISPLAY

(75) Inventors: Joon-Chok Leo, Sarawak (MY); Lon-Li Kevin Lim, Perak (MY); Rizal Jaffar, Melaka (MY)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 774 days.

(21) Appl. No.: 10/935,063

(22) Filed: Sep. 7, 2004

(65) Prior Publication Data

US 2006/0049781 A1 Mar. 9, 2006

(51) Int. Cl.
*G09G 3/36* (2006.01)

(52) U.S. Cl. ..... 345/102; 345/36; 345/39; 345/76

(58) Field of Classification Search ..... 345/102, 345/36, 39, 76

See application file for complete search history.

(56) References Cited

U.S. PATENT DOCUMENTS

| | | | | |
|---|---|---|---|---|
| 5,036,186 | A * | 7/1991 | Tsao | 250/208.1 |
| 6,344,641 | B1 | 2/2002 | Blalock et al. | |
| 6,448,550 | B1 * | 9/2002 | Nishimura | 250/226 |
| 6,507,159 | B2 | 1/2003 | Muthu | |
| 6,733,147 | B2 | 5/2004 | Wang et al. | |
| 6,753,661 | B2 | 6/2004 | Muthu et al. | |
| 7,033,059 | B2 * | 4/2006 | Yang et al. | 362/582 |
| 2006/0152931 | A1 * | 7/2006 | Holman | 362/297 |

OTHER PUBLICATIONS

Yutaka Inoue, "Development of a Large-Sized Backlight System for 37V LCD TV", Jan. 30, 2003, pp. 1-5.

Brad Lizotte, Global Lighting Technologies, Inc., "LCD Backlighting Technologies . . . Which one is best for you?", Jan. 1, 2001, 5 pages.

www.avdeals.com, "Learn About LCD TV and TFT LCD Displays, TFT LCD TV—What is TFT LCD?", 2003, 12 pages.

www.pctechguide.com, "PCTechGuide, Multimedia/Panel Displays", Mar. 13, 2003, 10 pages.

Sumio Shimonishi, "Control of Spectral Content in a Self-Emissive Display", U.S. Appl. No. 10/871,969, filed Jun. 18, 2004, 18 pages of specification including claims and abstract; and three sheets of formal drawings (Figs. 1-3).

* cited by examiner

*Primary Examiner*—Richard Hjerpe
*Assistant Examiner*—Leonid Shapiro

(57) ABSTRACT

A direct-firing backlight for a display is designed with a plurality of light emitting regions. Each of a plurality of light sensors is positioned to sense light produced by a corresponding one of the light emitting regions. A control system is operatively associated with the light sensors and light emitting regions. The control system receives information from the light sensors and, in response thereto, regulates light emitted from regions of a display. The regions of the display correspond to the light emitting regions of the direct-firing backlight. Various configurations of such a direct-firing backlight, and related methods, are also disclosed.

19 Claims, 3 Drawing Sheets

USE OF A PLURALITY OF LIGHT SENSORS TO REGULATE A DIRECT-FIRING BACKLIGHT FOR A DISPLAY

BACKGROUND

Liquid crystal display (LCD) backlighting using light emitting diodes (LEDs) poses a few advantages over LCD backlighting using a cold cathode fluorescent lamp (CCFL). Namely, an LED-based backlight can provide a wider color gamut, a selectable white point, a longer operating life, and a mercury-free lighting means. However, LED backlights also present a few difficulties. For example, the optical characteristics of LEDs vary with temperature, drive current and aging. LED optical characteristics can also vary from batch to batch within the same fabrication process.

Typically, LED backlighting is accomplished via a side-firing group or array of red, green and blue (RGB) LEDs that, together, produce a substantially white light. To maintain the uniformity of the white light, the RGB LEDs are usually mounted on a common substrate along with a light sensor. Brightness information (and sometimes chrominance information) obtained from the light sensor is then used to adjust the drive signals of the RGB LEDs, thereby controlling the intensity and chrominance of the backlight and maintaining the uniformity of the white light.

SUMMARY OF THE INVENTION

In one embodiment, apparatus comprises a direct-firing backlight for a display, a plurality of light sensors, and a control system. The direct-firing backlight has a plurality of light emitting regions, and each of the light sensors is positioned to sense light produced by a corresponding one of the light emitting regions. The control system is operatively associated with the light sensors and light emitting regions, to receive information from the light sensors and, in response thereto, regulate light emitted from regions of a display. The regions of the display correspond to the light emitting regions of the direct-firing backlight.

In another embodiment, a direct-firing backlight for a display is divided into a plurality of independently controllable light emitting regions. The light emitted from each of the light emitting regions is measured and compared to at least one reference value. In response to the comparisons, the light emitted from each light emitting region is independently regulated.

Other embodiments are also disclosed.

BRIEF DESCRIPTION OF THE DRAWINGS

Illustrative and presently preferred embodiments of the invention are illustrated in the drawings, in which.

DETAILED DESCRIPTION OF AN EMBODIMENT

Figure 1:
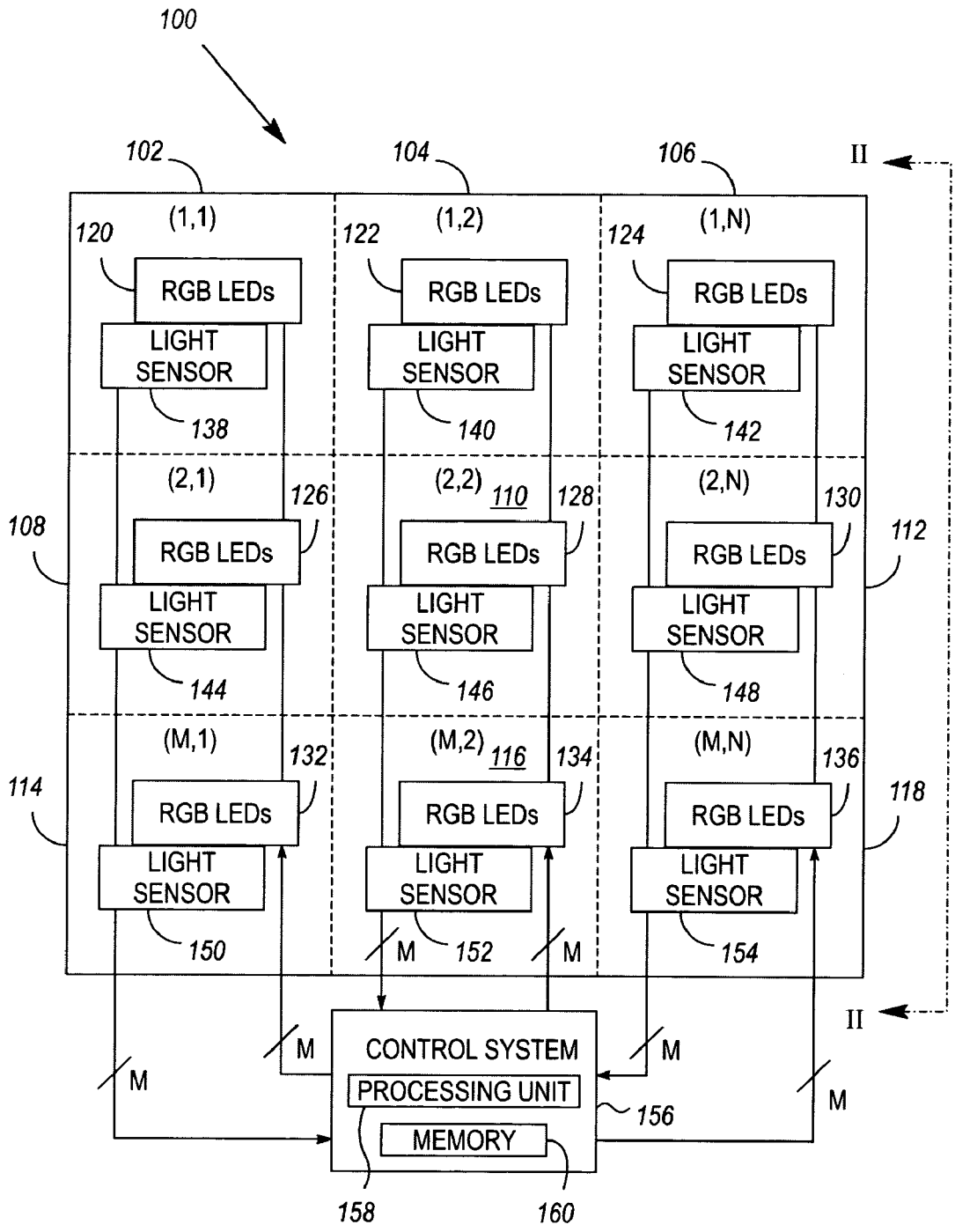
FIG. 1 illustrates an exemplary direct-firing backlight for a display.
Figure 2:
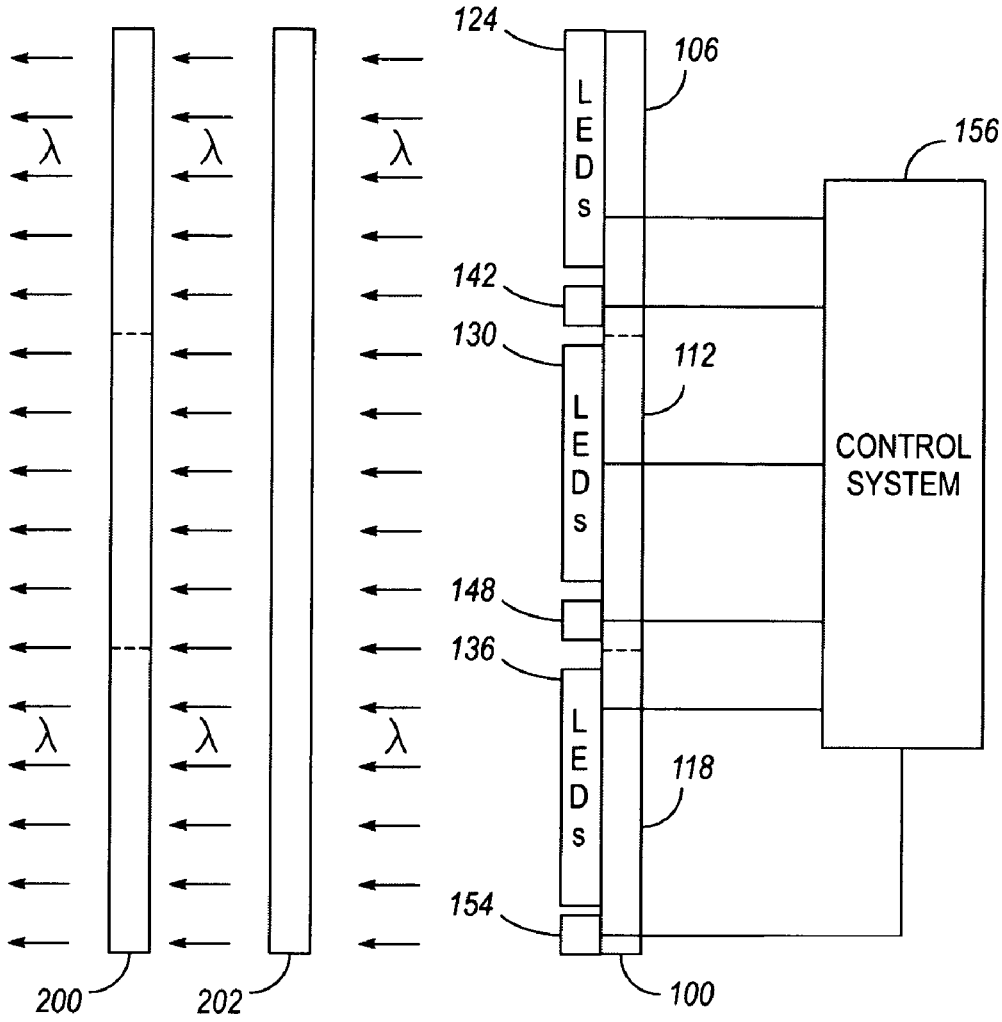
FIG. 2 illustrates an exemplary side view of the FIG. 1 backlight, as it would be placed behind a display to backlight the display.
Figure 3:
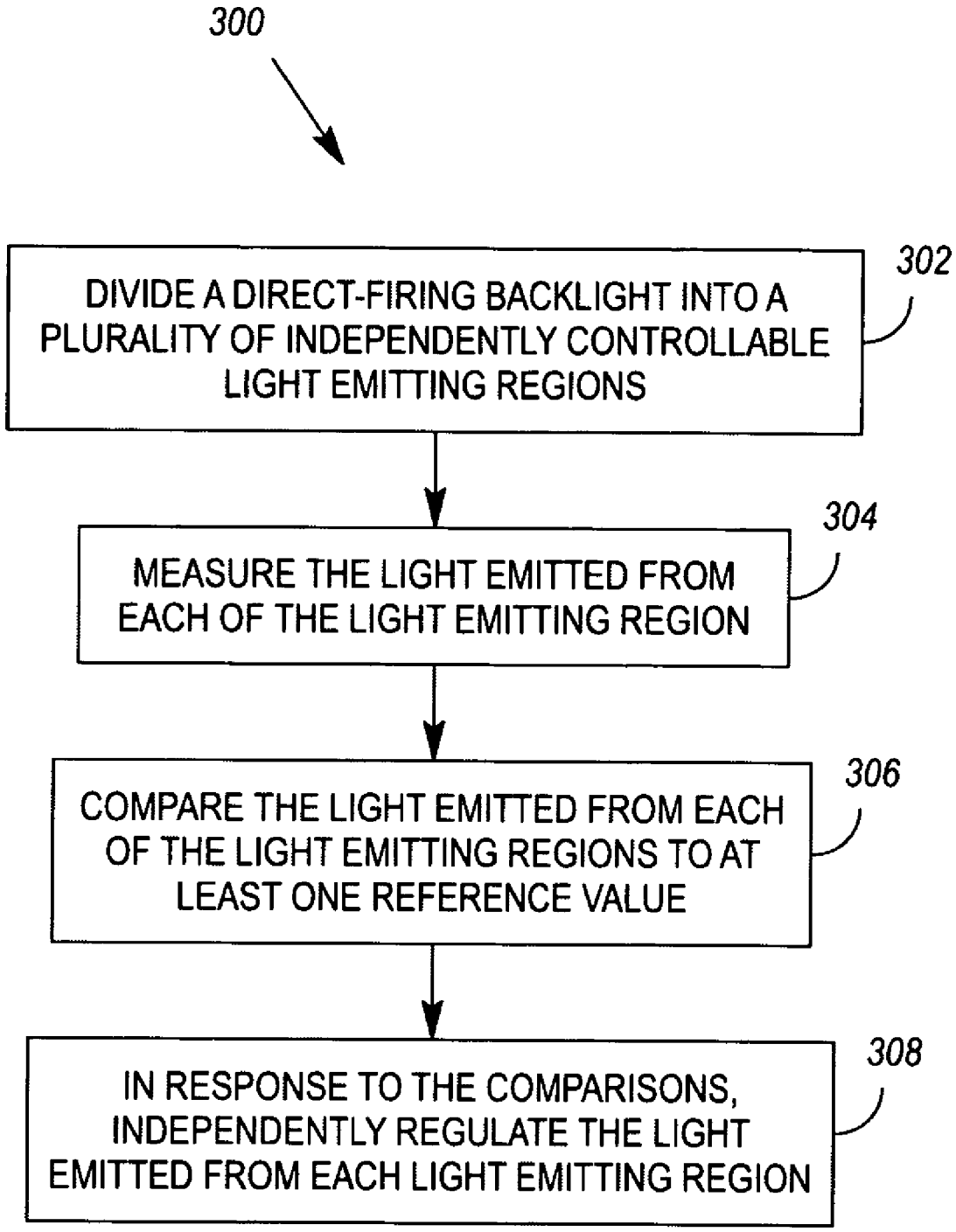
FIG. 3 illustrates a method for independently regulating the light emitted from each of a plurality of light emitting regions of a direct-firing backlight for a display.

For LCD displays of larger size, conventional side-firing LEDs have difficulty producing a well-dispersed backlight of uniform intensity and chrominance. One solution is to simply move the substrate holding the side-firing LEDs to a position that is behind the LCD display, thereby turning a side-firing LED backlight into a direct-firing LED backlight. However, the design of a light guide that sufficiently disperses the light produced by a direct-firing LED backlight is difficult; and, if the light guide is not adequate, the uniformity (i.e., intensity and chrominance) of the backlight suffers. Furthermore, the light sensed by a single light sensor mounted in close proximity to a group of LEDs forming a direct-firing backlight may not be a good indicator of the uniformity of the backlight as a whole. Although a light guide could be designed to not only disperse the light produced by the direct-firing LED backlight, but to also channel the dispersed light back to a light sensor, such a light guide is difficult to design and fabricate. FIGS. 1-3 therefore illustrate the use of a plurality of light sensors to regulate a direct-firing backlight for a display.

As shown in FIG. 1, a direct-firing backlight 100 for a display 200 (FIG. 2) is provided with a plurality of light emitting regions 102, 104, 106, 108, 110, 112, 114, 116, 118. Preferably, each light emitting region 102-118 comprises a plurality of LEDs 120, 122, 124, 126, 128, 130, 132, 134, 136. However, the regions 102-118 might also comprise laser diodes or some other form of light source. It is also preferable that each light emitting region 102-118 comprise light sources of different colors, such as red, green and blue (RGB) light emitting diodes 120-136. In this manner, both the brightness and chrominance of each region 102-118 may be controlled (as will be described later). In FIG. 1, the light emitting regions 102-118 are shown to be arranged in a matrix of M columns and N rows. However, the light emitting regions 102-118 could also be arranged in other ways, depending, for example, on factors such as 1) the shape of a display 200 to be backlit, 2) the radiation pattern and brightness of each light source 120-136, 3) the viewing angle and dynamic range of light sensors 138-154 that sense light emitted by the backlight regions 102-118 (described in more detail later in this description), and 4) the nature of any light guide 202 placed between the backlight 100 and a display 200.

In one embodiment, all of the light emitting regions 102-118 are formed on a common substrate. In another embodiment, each light emitting region 102-118 is formed on its own substrate. It should also be noted that, together, the light sources (e.g., LEDs 120-136) of the different light emitting regions 102-118 may form a substantially uniform matrix of light sources; or, the light sources 120-136 of each light emitting region 102-118 may be grouped in closer proximity to each other.

Interspersed with the light emitting regions 102-118 of the backlight 100 is a plurality of light sensors 138-154, each sensor of which is positioned to sense light produced by at least one of the light emitting regions 102-118. In one embodiment, the number of light sensors 138-154 equals the number of light emitting regions 102-118, and the light sensors 138-154 are spaced substantially equidistant from one another. Each light sensor 138-154 may be placed within its corresponding light emitting region 102-118, as shown in FIG. 1; or, each light sensor 138-154 may be placed in another location (e.g., with light from its corresponding backlight region 102-118 being directed to it via a light guide 202).

The light sensors 138-154 may take various forms. In one embodiment, the light sensors 138-154 measure light brightness. In another embodiment, the light sensors 138-154 measure both light brightness and light chrominance. In the former case, each light sensor 138-154 need only comprise a single photodiode. In the latter case, each light sensor 138-

154 could take the form of a plurality of photodiodes, each of which is associated with a filter that enables the brightness of only a predetermined wavelength (or wavelengths) of light to be measured. For example, three different photodiodes could be used to take readings related to Commission Internationale de l'Éclairage (CIE) tristimulus values. Alternately, the same readings could be taken serially, using a single photodiode associated with an adjustable light filter.

A control system 156 is operatively associated with both the light sensors 138-154 and light emitting regions 102-118. The control system 156 receives information from the light sensors 138-154 (e.g., brightness and/or chrominance information) and, in response thereto, regulates light emitted from regions of a display 200 (see FIG. 2). The regions of the display 200 from which light is emitted correspond to the light emitting regions 102-118 of the direct-firing backlight 100. Preferably, the boundaries of the display regions and backlight regions 102-118 substantially coincide. However, if one or more light guides 202 are positioned in front of the light emitting regions 102-118 of the backlight 100, between the backlight 100 and the display 200, the light guide(s) 202 can be used to disperse light to the display 200 such that the boundaries of corresponding display and backlight regions 102-118 need not correspond. Note that the light guide(s) 202 can also be used to disperse light to the light sensors 138-154. In one embodiment, the display 200 is an LCD , and light from the backlight 100 is emitted from behind the various liquid crystal elements of the display 200.

The control system 156 may regulate the light emitted from regions of a display 200 in a number of ways. In one embodiment, the control system 156 regulates the light by comparing information received from the light sensors 138-154 to at least one reference value and, in response thereto, regulating the light intensity of each light emitting region 102-118. Alternately, the control system 156 may regulate both the intensity and chromaticity of each light emitting region 102-118. In this second embodiment, the light sources of each light emitting region 102-118 may comprise different colored LEDs (e.g., RGB LEDs 120-136); the at least one reference value may comprise Commission Internationale de l'Éclairage (CIE) tristimulus values; and the control system 156 may regulate the LEDs 120-136 by regulating their drive signals.

In a third embodiment, the control system 156 regulates light emitted from regions of a display by comparing information received from the light sensors 138-154 to at least one reference value and, in response thereto, outputting required video signal adjustments for the display 200. In this embodiment, the light emitted by the backlight 100 remains uniform, and adjustments in the colors defined by a video signal are used to offset chrominance disparities between the regions 102-118 of the backlight 100. Video signal adjustments may also be used to compensate for slight disparities in the brightness of light emitted by different backlight regions 102-118. However, if the display 200 is an LCD, compensation for brightness variations will likely be limited.

The control system 156 preferably initiates its light comparisons and regulation on a periodic basis, during normal operation of the backlight 100. However, the control system 156 could also regulate the backlight 100 during a configuration mode, on power-up, or at other times.

The control system 156 may be a central control system (as shown), or may alternately comprise a plurality of distributed controllers (e.g., one for each light emitting region 102-118 of the backlight 100). The control System 156, or each controller thereof, may comprise a processing unit 158 and a memory 160. The memory 160 may store the one or more reference values, which may take the form of fixed values (e.g., values burned in a read-only memory (ROM)) or programmable values (e.g., user-configured values loaded in a random-access memory).

By way of example, FIG. 3 illustrates a method 300 for making and using a direct-firing backlight such as that which is shown in FIGS. 1 & 2. In accordance with the method 300, a direct-firing backlight 100 for a display 200 is divided 302 into a plurality of independently controllable light emitting regions 102-118. The light emitted from each of the light emitting regions 102-118 is then measured 304 and compared 306 to at least one reference value. In response to the comparisons, light emitted from each light emitting region 102-118 is then independently regulated 308.

What is claimed is:

1. Apparatus, comprising:

an LCD display;

a direct-firing backlight for the LCD display, said direct-firing backlight having a plurality of light emitting regions, wherein each light emitting region comprises a plurality of light sources;

a plurality of light sensors, each of which is positioned to sense light produced by at least one of said light emitting regions;

a light guide located between the LCD display and the direct-firing backlight, the light guide configured to receive light emitted by the direct-firing backlight upon a first major surface of the light guide and propagate a first portion of the received light out of an opposing major surface and towards the LCD display, the light guide further configured to reflect a second portion of the received light towards at least one of the plurality of light sensors; and a control system comprising a memory in which is stored a reference value, the control system configured to receive light information from said light sensors, compare the light information against the reference value and, in response thereto, regulate light emitted from the LCD display.

2. The apparatus of claim 1, wherein the light sources are light emitting diodes.

3. The apparatus of claim 1, wherein the number of said light sensors equals the number of said light emitting regions.

4. The apparatus of claim 1, wherein the light sensors are colorimetric sensors, and wherein the information the light sensors provide to the control system is related to Commission Internationale de l'Éclairage(CIE)tristimulus values.

5. The apparatus of claim 1, wherein the control system initiates said comparison on a periodic basis during normal operation of said direct-firing backlight.

6. A method, comprising:

dividing a direct-firing backlight into a plurality of independently controllable light emitting regions, each light emitting region comprising a plurality of light sources;

positioning the direct-firing backlight for providing backlighting to a display;

storing in a memory, a reference value corresponding to an intensity of light;

measuring the light emitted from each of said light emitting regions;

comparing the light emitted from each of said light emitting regions to said reference value;

in response to said comparisons, independently regulating the light emitted from each light emitting region; and inserting a light guide between the direct-firing backlight and the display, the light guide configured to propagate through the light guide and towards the display, a first portion of light received from the direct-firing backlight, and further configured to reflect a second portion of light received from the direct-firing backlight towards a photodiode.

7. The method of claim 6, wherein the memory is a random access memory, and storing the reference value comprises a user storing a programmable value in the random access memory.

8. The method of claim 6, wherein the memory is a read-only memory, and storing the reference value comprises burning a fixed value into the read-only memory.

9. The method of claim 6, wherein measuring the light from each of said light emitting regions is a serial measurement comprising:

coupling a first filter to the photodiode;

measuring light of a first color;

coupling thereafter, a second filter to the photodiode; and measuring light of a second color.

10. The method of claim 6, further comprising:

providing a uniform level of brightness from the direct-firing backlight; and regulating light emitted from various portions of the display, by adjusting at least one video signal driving the display.

11. A light system, comprising:

an LCD display having a first boundary;

a backlight having a plurality of light-emitting regions, the backlight having a second boundary that is different than the first boundary; and a light guide located between the LCD display and the backlight, the light guide configured to receive light emitted by the backlight upon a first major surface of the light guide and propagate a first portion of the received light out of an opposing major surface towards the LCD display for providing dispersed backlighting that encompasses the first boundary of the LCD display.

12. The light system of claim 11, wherein the backlight comprises a plurality of sensors for sensing light produced by the plurality of light emitting regions, and wherein the light guide is further configured to reflect a second portion of the received light towards at least one sensor in the plurality of sensors.

13. The light system of claim 12, wherein the at least one sensor is a photodiode that is coupled to an adjustable filter, wherein the adjustable light filter is adjustable to have a first selected configuration for propagating light of a first color, and a second selected configuration for propagating light of a second color.

14. The light system of claim 12, further comprising:

a memory in which is stored a reference value corresponding to at least one of a) brightness of light or b) light chrominance; and a control system configured to receive light information from said plurality of light sensors, compare the received light information against the reference value and use the result of the comparison for controlling the uniformity of light emitted by the LCD display.

15. The light system of claim 14, wherein controlling the uniformity of light emitted by the LCD display comprises providing a drive signal for controlling at least one light-emitting device located in one of the plurality of light-emitting regions.

16. The light system of claim 15, wherein the light-emitting device is one of a) an LED or b) a laser diode.

17. The light system of claim 14, wherein controlling the uniformity of light emitted by the LCD display comprises providing a video signal for driving the LCD display.

18. The light system of claim 11, wherein each of the plurality of light-emitting regions comprises a plurality of light-emitting devices, and the light system comprises:

a first light-emitting device located in a first light-emitting region of the plurality of light-emitting regions; and a light sensor located in a second light-emitting region that is different than the first light-emitting region, the light guide configured to reflect towards the light sensor, light received from the first light-emitting device located in the first light-emitting region.

19. The light system of claim 11, further comprising:

a first substrate defining a first light-emitting region;

a first light-emitting device mounted on the first substrate;

a second substrate that is different than the first substrate, the second substrate defining a second light-emitting region; and a light sensor mounted on the second substrate, the light pipe configured to reflect towards the light sensor, light received from the first light-emitting device mounted on the first substrate.

* * * * *

UNITED STATES PATENT AND TRADEMARK OFFICE

CERTIFICATE OF CORRECTION

PATENT NO. : 7,474,294 B2
APPLICATION NO. : 10/935063
DATED : January 6, 2009
INVENTOR(S) : Lee et al.

It is certified that error appears in the above-identified patent and that said Letters Patent is hereby corrected as shown below:

On the Title page,

Item (12) “Leo et al.” should read -- Lee et al. --.

Item (75) Inventor “Joon-Chok Leo” should read -- Joon-Chok Lee --; “Lon-Li Kevin Lim” should read -- Len Li Kevin Lim --.

Signed and Sealed this

Fourth Day of August, 2009

JOHN DOLL
*Acting Director of the United States Patent and Trademark Office*